US009827472B2

(12) United States Patent
Kammerer et al.

(10) Patent No.: US 9,827,472 B2
(45) **Date of Patent: *Nov. 28, 2017**

(54) GOLF PUTTER WITH ADJUSTABLE COUNTERBALANCE WEIGHT

(71) Applicant: Karsten Manufacturing Corporation, Phoenix, AZ (US)

(72) Inventors: Brian Kammerer, Fort Worth, TX (US); David N. Franklin, Granbury, TX (US); John Hatfield, Granbury, TX (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 2 days.

This patent is subject to a terminal disclaimer.

(21) Appl. No.: 14/961,095

(22) Filed: Dec. 7, 2015

(65) Prior Publication Data

US 2016/0082329 A1 Mar. 24, 2016

Related U.S. Application Data

(63) Continuation-in-part of application No. 14/628,846, filed on Feb. 23, 2015, now Pat. No. 9,265,998, which is a continuation-in-part of application No. 14/493,397, filed on Sep. 23, 2014, now Pat. No. 9,266,000.

(51) Int. Cl.

| | |
|---|---|
| ***A63B 53/16*** | (2006.01) |
| ***A63B 60/24*** | (2015.01) |
| ***A63B 53/00*** | (2015.01) |
| ***A63B 53/14*** | (2015.01) |

(52) U.S. Cl.
CPC ..... *A63B 60/24* (2015.10); *A63B 53/007* (2013.01); *A63B 53/14* (2013.01); *A63B 2209/02* (2013.01)

(58) Field of Classification Search
CPC ..... A63B 53/14; A63B 53/007; A63B 60/24; A63B 2209/02
See application file for complete search history.

(56) References Cited

U.S. PATENT DOCUMENTS

| | | | |
|---|---|---|---|
| 2,051,083 | A | 8/1936 | Hart |
| 5,269,518 | A | 12/1993 | Kobayashi et al. |
| 5,460,378 | A | 10/1995 | Getts |
| 5,465,967 | A | 11/1995 | Boeckenhaupt |
| 5,494,288 | A | 2/1996 | Jimenez et al. |
| 5,554,078 | A | 9/1996 | Hannon et al. |
| 5,632,691 | A | 5/1997 | Hannon et al. |
| 5,699,632 | A | 12/1997 | Stout et al. |
| 7,704,160 | B2 | 4/2010 | Lindner |
| 7,704,161 | B2 | 4/2010 | Lindner |
| 8,177,658 | B1 | 5/2012 | Johnson |
| 8,444,502 | B2 | 5/2013 | Karube |
| 8,641,551 | B2 | 2/2014 | Johnson |
| 2005/0054459 | A1 | 3/2005 | Oldenburg |

(Continued)

*Primary Examiner* — Stephen Blau

(57) ABSTRACT

A golf club includes a tubular shaft, a golf club head affixed to a first end of the tubular shaft, and a grip abutting a second end of the shaft. The golf club further includes an adjustable counterbalance that is insertable within a hollow recess of the grip. The adjustable counter balance includes an elongate member adapted to be secured to the tubular shaft, and a movable weight. The movable weight is selectively transitionable between a first, unlocked state that permits translation of the weight along the elongate member, and a second locked state that restrains the weight from free translation.

16 Claims, 2 Drawing Sheets

(56) References Cited

U.S. PATENT DOCUMENTS

| | | | |
|---|---|---|---|
| 2006/0009303 | A1 | 1/2006 | Prince et al. |
| 2010/0105498 | A1 | 4/2010 | Johnson |
| 2013/0165249 | A1 | 6/2013 | Margoles et al. |

GOLF PUTTER WITH ADJUSTABLE COUNTERBALANCE WEIGHT

CROSS REFERENCE TO RELATED APPLICATIONS

This application is a continuation-in-part of and claims the benefit of priority from U.S. application Ser. No. 14/628,846, filed Feb. 23, 2015, which is a continuation-in-part of and claims the benefit of priority from U.S. application Ser. No. 14/493,397, filed Sep. 23, 2014, both of which are hereby incorporated by reference in their entirety.

TECHNICAL FIELD

The present invention relates generally to a golf putter having an adjustable counterbalance weight.

BACKGROUND

Putting is one of the most precise aspects of the game of golf. It requires a considerable amount of consistency to properly align and strike a ball so that it rolls on an intended line for a desired distance. To facilitate a consistent stroke, many golfers look favorably on a putter that provides smooth stroke, good glide, pure impact, and a bounce-less topspin ball launch.

One strategy to remove uncertainty in a putting stroke has been to anchor an extended length putter into the midsection of the golfer. Doing so reduces the total number of degrees of freedom that must be successfully controlled to provide a smooth, substantially planar stroke. Such a practice has been prohibited by rules established by the USGA and R&A rule making bodies. As such, club manufacturers have taken on a renewed interest in the design of the putter to fill the void left by the prohibition on anchored-style putters.

SUMMARY

In one embodiment, a golf club includes a tubular shaft, a golf club head affixed to a first end of the tubular shaft, and a grip abutting a second end of the shaft. The golf club further includes an adjustable counterbalance that is insertable within a hollow recess of the grip. The adjustable counter balance includes an elongate member adapted to be secured to the tubular shaft, and a movable weight. The movable weight is selectively transitionable between a first, unlocked state that permits translation of the weight along the elongate member, and a second locked state that restrains the weight from free translation.

In another embodiment a golf club includes a tubular shaft that extends between a first end. The tubular shaft has an inner surface that defines a hollow recess and has a length of from about 35 inches to about 38 inches. A putter head is affixed to the first end of the tubular shaft, where the head has a loft angle of from about 0 degrees to about 6 degrees and a mass of from about 360 grams to about 390 grams. A movable weight is disposed within the hollow recess and is selectively repositionable throughout a translatable range of from about 250 mm to about 400 mm, where the translatable range extends from the second end of the tubular shaft toward the first end. Furthermore, the movable weight has a mass of from about 60 grams to about 80 grams, which together with the heavier than normal head, provides a smooth putter stroke that simulates that of an anchored putter.

The above features and advantages and other features and advantages of the present invention are readily apparent from the following detailed description of the best modes for carrying out the invention when taken in connection with the accompanying drawings.

DETAILED DESCRIPTION

Figure 1:
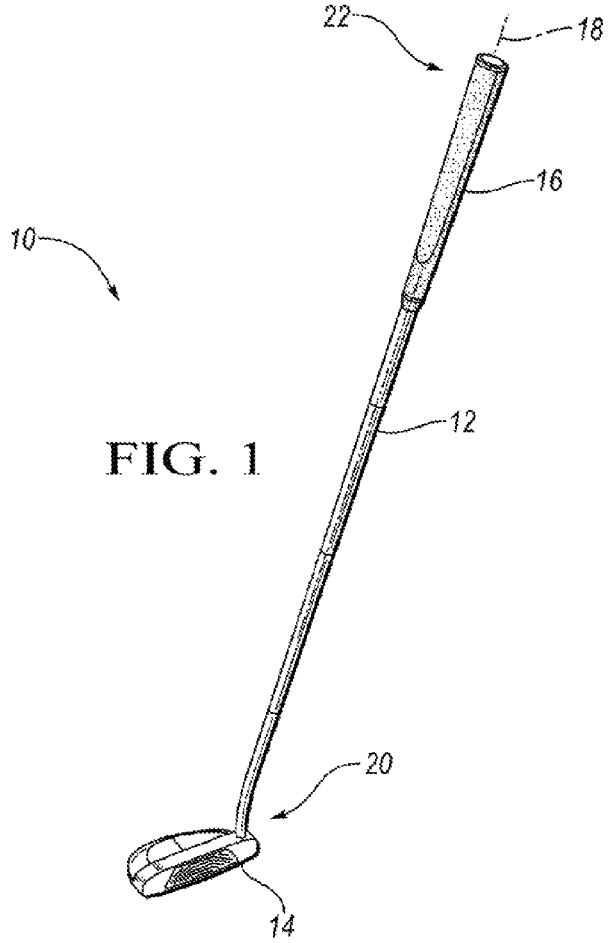
FIG. 1 is a schematic side view of a golf club, such as a putter.

Referring to the drawings, wherein like reference numerals are used to identify like or identical components in the various views, FIG. 1 schematically illustrates a golf club 10 that includes a shaft 12, a golf club head 14, and a grip 16. The shaft 12 is generally disposed along a longitudinal axis 18 and extends between a first end 20 and a second end 22. The golf club head 14 is affixed to the first end 20 of the shaft 12, and the grip 16 is circumferentially disposed about the outside of the shaft 12 such that the grip 16 abuts the second end 22. The total length of the golf club 10 may be from about 30 inches to about 50 inches, or from about 34 inches to about 40 inches, or even from about 35 inches to about 38 inches. In general, the grip 16 may be a non-metallic wrap or sleeve that is gripped by a user when swinging the club. Suitable materials for the grip typically include a rubber, leather, or synthetic leather material. The grip 16 may have a length of, for example, about 15 inches, extending from the second end 22 of the shaft 12. In one configuration, the golf club head 14 is a putter head that has a loft angle of from about 0 degrees to about 6 degrees, and a head mass of from about 300 g to about 500. In other embodiments, the club head 14 may have a head mass of from about 325 g to about 425 g, or from about 360 g to about 400 g, or from about 360 g to about 390 g, or even from about 365 g to about 375 g. In one particular example, the head mass may be about 368 g to about 372 g. Such a design may be viewed as having a heavier head than typical or traditional putters, but it has been found that the heavier head may provide a smoother stroke and additional control, particularly on fast greens.

Figure 2:
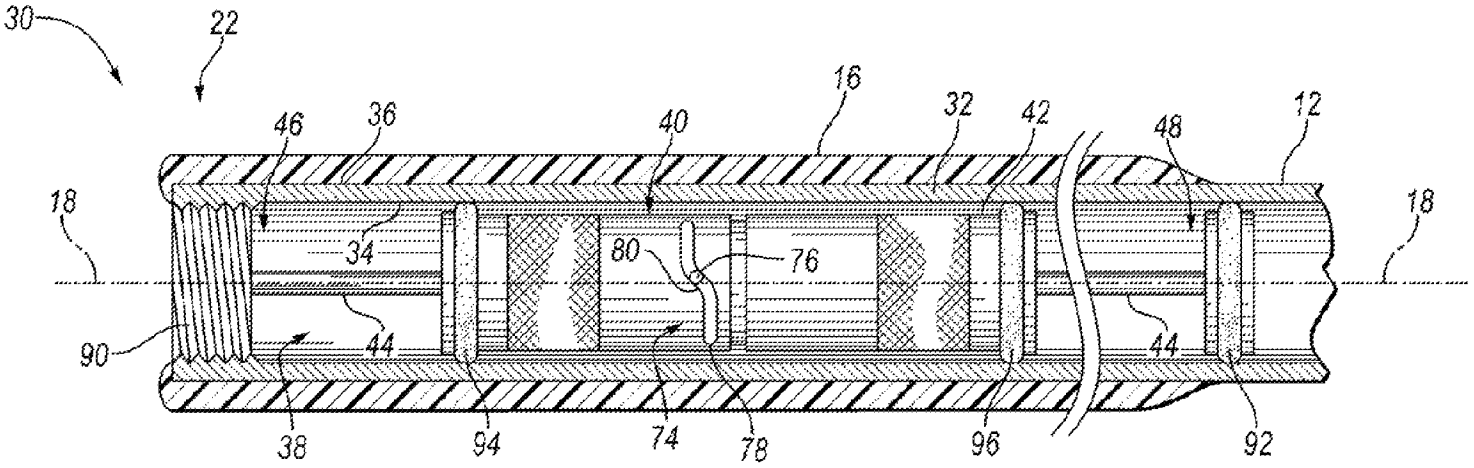
FIG. 2 is a schematic partial cross-sectional side view of a putter having an adjustable counterbalance disposed within a hollow recess of a shaft of a golf club.

FIG. 2 schematically illustrates a partial cross-sectional view 30 of the shaft 12 of FIG. 1. As shown, the shaft 12 includes a tubular body 32 having an inner surface 34 and an outer surface 36 that are substantially concentric and aligned with the longitudinal axis 18. The grip 16 is disposed about the outer surface 36, and the inner surface 34 defines a hollow recess 38. An adjustable counterbalance 40 may be disposed within the hollow recess 38, and may enable a movable weight 42 to be selectively repositioned by a user at an intended location within the shaft 12. By repositioning the movable weight 42 within the shaft 12, the user may alter the feel and response of the club 10 when it is swung. For certain placements and sizes of the movable weight 42, the feel or swing profile of the club 10 may be similar to that of an anchored putter. While the anchored putter feel is highly golfer-specific, it has been found that the combination of longer shaft lengths (e.g., about 35 inches to about 38 inches) and heavier putter heads (e.g., about 360 g to about 400 g, or more preferably about 360 g to about 390 g) suitably mimic the anchored feel when combined with the movable weight 42 described herein.

As shown in FIG. 2, the adjustable counterbalance 40 includes an elongate member 44 that is configured to be substantially aligned with the longitudinal axis 18 of the shaft 12. The elongate member 44 may include a rod formed from a suitably light weight, yet resilient material, such as, for example, an aluminum, a carbon fiber-wrapped aluminum, and/or a polymeric material. Examples of suitable polymers may include one or more polyamides, polyimides, polyamide-imides, polyetheretherketones (PEEK), polycarbonates, engineering polyurethanes, and/or other similar materials. In general, the polymeric material may be a either thermoplastic or thermoset, and may be unfilled, filled with a chopped fiber such as a glass fiber or a carbon fiber, or may have other suitable fillers and/or additives to promote increased strength. The rod may have a diameter that is from about 10% to about 25% of the diameter of the hollow recess 38. Likewise, the rod may have a length of from about 300 mm to about 450 mm, or from about 350 mm to about 400 mm. In one particular example, the rod may have a length of about 15 inches or about 380 mm.

In one configuration, the movable weight 42 may be generally annular in nature and may radially surround the elongate member 44. The weight 42 may be selectively affixed to the elongate member 44 to facilitate a semi-permanent placement of the weight 42. For example, the weight 42 may be transitionable between a first, unlocked state and a second, locked state at the urging of the user. When configured in a first, unlocked state, the annular weight 42 may be translatable throughout a translatable range (e.g., between a first end 46 and a second end 48 of the elongate member 44). Once the annular weight 42 is suitably positioned by a user, the weight 42 may be transitioned into a second, locked state, where it is then restrained from further translation.

Figure 3:
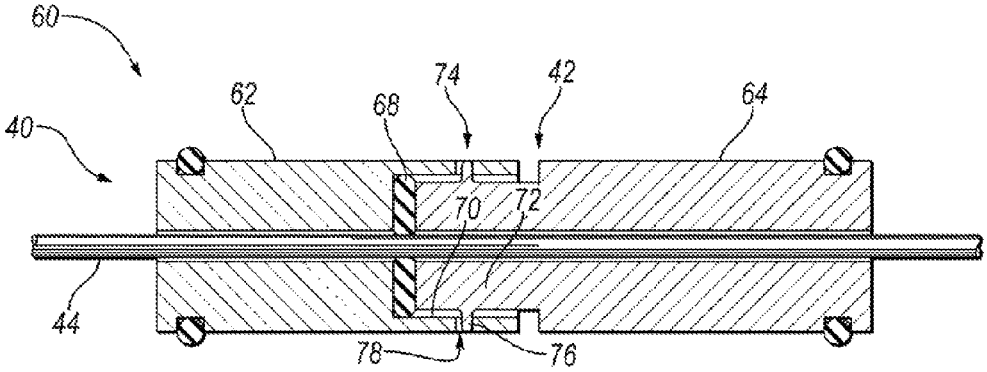
FIG. 3 is a schematic cross-sectional side vice of an embodiment of an annular weight portion of an adjustable counterbalance for a golf club.

FIG. 3 schematically illustrates a partial cross-sectional view 60 of an embodiment of an annular weight 42 that is configured to be selectively translatable along the elongate member 44. As shown, the annular weight 42 may include a first section 62 and a second section 64 that each circumferentially surround the elongate member 44 and are adjacent to each other along the length of the member 44.

In one embodiment, the annular weight 42 shown in FIG. 3 may selectively transition between the first, locked state and the second, unlocked state by rotating the first section 62 relative to the second section 64 about the elongate member 44. In one configuration, the transition may be completed through a relative rotation of from about 45 degrees to about 180 degrees. In another configuration, the transition may be completed through a relative rotation of from about 80 degrees to about 130 degrees, or approximately from about a quarter of a full rotation to about a third of a full rotation. In one embodiment, this relative rotation may draw the respective sections 62, 64 toward each other to apply an axially compressive force to a grommet 68 located between the two sections 62, 64. The applied compressive force causes the grommet 68 to radially expand against the elongate member 44 with a sufficient contact force to inhibit the annular weight 42 from freely translating along the elongate member 44 (i.e., selectively affixing the annular weight 42 to the elongate member 44). The grommet 68 may be formed from a polymeric material and may have a hardness, measured on the Shore A scale, of from about 40 A to about 90 A, though more preferably from about 70 A to about 90 A.

The desired holding force between the movable weight 42 and the elongate member 44 is preferably greater than about 8 lbf when in a locked configuration. In one configuration, the locked configuration may be characterized by a holding force of from about 8 lbf to about 20 lbf, or even from about 8 lbf to about 15 lbf. These ranges are intended to approximate the impact loading of the club being dropped or being aggressively placed into a golf bag. Conversely, while in the unlocked state, the holding force is preferably less than about 1 lbf, or even more preferably less than about 0.5 lbf. To accomplish the desired locked-holding force without requiring an excessively large locking torque (i.e., a torque larger than an average person can provide without a tool), particular attention must be given to the physical and material design of the grommet 68.

In general, the grommet 68 should be dimensioned to be in a close arrangement with a stationary locking surface when the weight 42 is in an unlocked state, and should be dimensioned to make forcible contact with the locking surface when in an unlocked state. In the embodiment shown in FIG. 3, the locking surface would be the OD of the elongate member 44. Therefore, the ID of the grommet 68, when in a relaxed state, should be designed/dimensioned to have a maximum clearance relative to the elongate member 44 of up to about 0.1 mm, or up to about 3% of the radial thickness of the grommet 68. In a more preferable configuration, the grommet 68 the ID of the grommet 68 is designed/dimensioned to have a slight interference fit against the locking surface. This interference may be up to about 0.15 mm, or up to about 5% of the radial thickness of the grommet 68.

It has been found that, in the present design, grommets formed from certain polymers can take a compression set that causes the grommet 68 to lose holding power. This durability issue has been overcome by forming the grommet from a material that is sufficiently resistant to taking a compression set, though still sufficiently soft to enable locking by hand. These properties have been obtained by annealing an otherwise suitable thermoplastic polyurethane grommet to improve the compression set resistance and long-term holding power. A suitable annealing process may involve maintaining the grommet in a 70 degree Celsius environment for 22 hours.

As noted above, the maximum torque required to secure the weight 42 in place should be low enough to perform by hand (preferably without the need for a tool). For example, in one configuration, the maximum required torque that is needed to lock the weight 42 in-place should be less than about 7.0 inch-pounds. To aid in the manual rotation, in one configuration, the outer surface of a portion of each section 62, 64 may be knurled or otherwise textured.

In one particular design, such as shown in FIG. 3, the first section 62 may define a recess 70 that is configured to receive, and radially surround a portion 72 of the second section 64. An annular grommet 68 may be disposed within the recess 70 such that it is radially positioned between the elongate member 44 and a portion of the first section 62. The nested portion 72 of the second section 64 may be drawn into or out of the recess 70 at the urging of a locking interface 74.

The locking interface 74 may include, for example, threaded portions of the first and second sections 62, 64 that cooperate to cause a relative translation of the sections 62, 64. In another embodiment, such as shown in FIG. 3, the locking interface 74 may include a protrusion 76 and a ramped slot 78 or track, similar to a BNC-style coaxial wire connector. The protrusion may extend in a radial direction from one of the first and second sections 62, 64, and the slot 78 or track may be defined by the other. The slot 78 may extend around a portion of the circumference of the annular weight 42, and may include a length 80 that is ramped in an axial direction. The protrusion 76 may be captured within the slot 78, and a relative rotation of the first and second sections 62, 64 would result in a relative translation of the sections 62, 64 (particularly as the protrusion 76 moves through the ramped length 80 of the slot 78). In one embodiment, the slot 78 may be provided in the first section 62, and the protrusion 76 may extend radially outward from the nested portion 72 of the second section 64.

Figure 4:
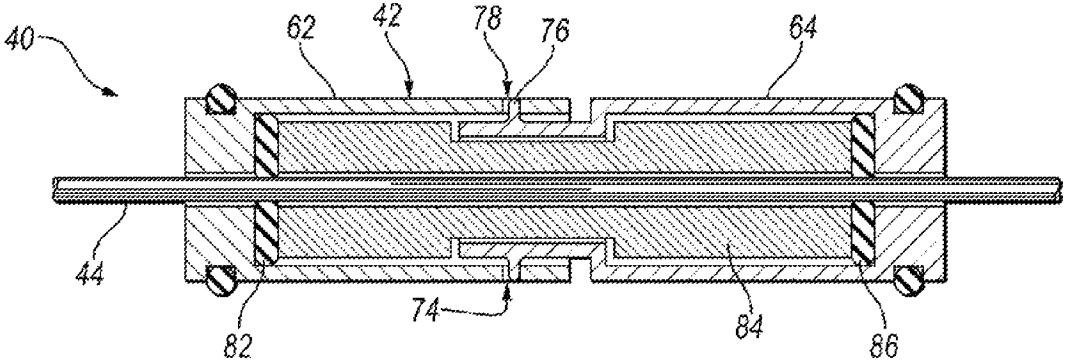
FIG. 4 is a schematic cross-sectional side vice of an embodiment of an annular weight portion of an adjustable counterbalance for a golf club.

In another design, the annular weight 42 may include two or more annular grommets 68 that are operative to selectively restrain translation of the weight 42 along the elongate member 44. For example, as shown in FIG. 4, the annular weight may include a first annular grommet 82 disposed between the first section 62 and a weight tube 84, and may include a second annular grommet 86 disposed between the second section 64 and the weight tube 84. The first and second sections 62, 64 may meet at a similar locking interface 74 as described above, though transitioning from an unlocked state to a locked state may involve compressing each of the first and second grommets 82, 86 against the weight tube 84. The compressive force may cause the first annular grommet 82 to expand between the elongate member 44 and the first section 62 and may cause the second annular grommet 86 to expand between the elongate member 44 and the second section 64. In still further designs, the weight tube 84 may be subdivided with additional annular grommets disposed at intermediate locations between sections of the weight tube.

Referring again to FIG. 2, the adjustable counterbalance 40 is configured to be selectively secured to the second end 18 of the shaft 12. In one configuration, the adjustable counterbalance 40 includes a securing means coupled with the elongate member 44 at, or proximate to, the first end 46 of the member 44. The securing means may be configured to selectively couple the adjustable counterbalance 40 to the second end 18 of the shaft 12. In one configuration, the securing means is an externally threaded cap 90 that is affixed to the first end 46 of the elongate member 44. The externally threaded cap 90 is configured to cooperate with a threaded portion of the inner surface 34 of the shaft 12 to secure the cap 90 within the hollow recess 38. In other configurations, the securing means may be a press-fit style connection, or may include an internally threaded, lid-style cap that may screw onto a portion of the end of the shaft 12.

A stabilizing grommet 92 may be disposed on the second end 48 of the elongate member 44, and may be used to stabilize the elongate member 44 within the hollow recess 38. This stabilizing grommet 92 has an external diameter that is dimensioned so that when the grommet 92 is inserted within the tubular body of the golf club shaft, it may apply a contact force against the inner surface 34 of the shaft 12. Additionally, one or more stabilizing grommets 92 may be disposed on the annular weight 42 for a similar, stabilizing purpose. For example, as shown in FIG. 2, in one configuration, a first stabilizing grommet 94 may be disposed around the first section 62 and a second stabilizing grommet 96 may be disposed around the second section 64. Each stabilizing grommet 94, 96 may be compressed between the respective section 62, 64 and the inner surface 34 of the shaft when the adjustable counterbalance 30 is inserted within the hollow recess 38.

In one configuration, an adjustable counterbalance 30 for a putter, may enable a mass of from about 30 g to about 100 g to be movable within a hollow recess 38 of the shaft 12 throughout a translatable range of from about 200 mm to about 500 mm. Said another way, in this embodiment, the movable weight 42 may have a mass (i.e. a "movable mass") of from about 30 g to about 100 g, where the center of mass for the movable weight 42 is translatable along the elongate member 44 (and securable thereto) throughout a range of from about 200 mm to about 500 mm. In other configurations, the adjustable counterbalance 30 may enable a mass of from about 60 g to about 80 g to be movable within the hollow recess 38 throughout a range of from about 250 mm to about 400 mm. In one particular example, the adjustable counterbalance 30 may enable a mass of about 65 g to about 75 g to be movable within the hollow recess 38 throughout a range of about 250 to about 350 mm. In one configuration, the translatable range may extend from the second end 22 of the shaft 12 toward the first end 20. In this manner, all or most of the translatable range may be coincident with the grip 16. These movable mass and translation ranges have been found to provide the ideal amount of counterbalancing and adjustability to provide certain stabilizing effects found with an anchored putter.

The entire mass of the adjustable counterbalance 40 may be from about 50 g to about 120 g, which includes from about 30 g to about 100 g of movable mass, and about 20 g of fixed mass (i.e., mass of the elongate member 44 and other stationary components). In one configuration, the grip 16 may define a "grip portion" of the club. More specifically, the grip portion includes the entire portion of the golf club that is coincident with the grip 16. As noted above, the movable weight 42 may be selectively repositionable within the grip portion to provide the feel of an anchored putter. The grip portion may have a total fixed mass (i.e., the mass of the non-repositionable elements) that is from about 60 g to about 120 g. In another embodiment, the total fixed mass of the grip portion is from about 80 g to about 100. In one particular embodiment, the total fixed mass of the grip portion may be about 90 g.

To provide the most optimal feel and adjustability to a golfer, the amount of the movable mass may fall within certain proportions, such as expressed by the ratio of movable mass to head mass and/or to the fixed mass within the grip portion. In one configuration, the ratio of the head mass to the movable mass may be from about 3:1 to about 11:1, or from about 3:1 to about 8:1, or even from about 4:1 to about 6:1. In a particular example, the ratio of the head mass to the movable mass may be about 4.5:1 to about 5.5:1, which may provide a suitable amount of swingweight/inertia on the clubhead to provide a desirably smooth stroke while still affording sufficient counterbalancing adjustability. Likewise, the ratio of the fixed grip mass to the movable mass may be from about 0.5:1 to about 4:1, or from about 0.5:1 to about 2:1, or even from about 0.75:1 to about 2.0:1. In a particular example, the ratio of the fixed grip mass to the movable mass may be about 1.2:1, which may provide a suitable ability to re-locate the center of mass of the heavier-than-normal grip portion.

In one configuration, the elongate member 44 may be color coded, or may have other suitable visual markings, that may allow a user to quickly identify specific regions or weight configurations that may be desirable. For example, in one embodiment, there may be at least three colored regions along the length of the elongate member 44. These may correspond to high, mid, and low weight configurations.

While various embodiments have been described, the description is intended to be exemplary, rather than limiting and it will be apparent to those of ordinary skill in the art that many more embodiments and implementations are possible. Accordingly, the invention is not to be restricted except in light of the attached claims and their equivalents. Also, various modifications and changes may be made within the scope of the attached claims.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

The invention claimed is:

1. A golf club comprising:

a tubular shaft extending between a first end and a second end, the tubular shaft having an inner surface that defines a hollow recess;

a golf club head affixed to the first end of the tubular shaft;

a grip disposed about the tubular shaft and abutting the second end of the tubular shaft, wherein the grip defines a grip portion of the golf club;

an adjustable counterbalance that is insertable within the hollow recess of the grip portion, the adjustable counterbalance including:

an elongate member adapted to be secured to the tubular shaft; and a movable weight that is selectively transitionable between a first, unlocked state and a second locked state, the movable weight including a grommet formed from an annealed thermoplastic polyurethane material, and wherein:

the movable weight is translatable along the elongate member when in the unlocked state, and is restrained from translation relative to the elongate member when in the locked state;

the grommet receives a compressive force when in the locked state that urges the grommet into forcible contact with the elongate member; and the forcible contact between the grommet and the elongate member when in the locked state restrains the movable weight from translation.

2. The golf club of claim 1, wherein the elongate member is removable from the tubular shaft to facilitate repositioning of the movable weight along the elongate member.

3. The golf club of claim 1, wherein the movable weight is translatable along the elongate member by an applied force of less than about 1 lbf when in the unlocked state, and wherein the locked state is characterized by a holding force between the movable weight and the elongate member of from about 8 lbf to about 20 lbf.

4. The golf club of claim 1, wherein the movable weight includes a first section and a second section;

wherein the movable weight is transitionable between the unlocked state and the locked state by rotating the first section relative to the second section about a longitudinal axis of the elongate member; and wherein each of the first section and the second section are rotatable relative to the elongate member when in the unlocked state.

5. The golf club of claim 4, wherein rotating the first section relative to the second section to transition the movable weight from the unlocked state to the locked state requires a torque of less than about 7.0 inch-pounds and may be performed by a user without the assistance of a tool; and wherein the movable weight is translatable along the elongate member by an applied force of less than about 1 lbf when in the unlocked state, and wherein the locked state is characterized by a holding force between the movable weight and the elongate member of from about 8 lbf to about 20 lbf.

6. The golf club of claim 1, wherein the golf club head is a putter head having a loft angle of from about 0 degrees to about 6 degrees and a mass of from about 360 grams to about 400 grams.

7. The golf club of claim 1, wherein the movable weight is positionable within the grip portion throughout a total range of from about 250 mm to about 400 mm.

8. The golf club of claim 1, wherein the grip portion has a fixed mass; and wherein a ratio of the fixed mass to the mass of the movable weight is from about 0.75:1 to about 2.0:1.

9. The golf club of claim 1, wherein the elongate member adapted to be secured to the tubular shaft by screwing a portion of the elongate member into a threaded portion of the elongate shaft.

10. A golf putter comprising:

a tubular shaft extending between a first end and a second end, the tubular shaft having an inner surface that defines a hollow recess and a length of from about 35 inches to about 38 inches;

a putter head affixed to the first end of the tubular shaft, the putter head having a loft angle of from about 0 degrees to about 6 degrees and a mass of from about 360 grams to about 390 grams;

an adjustable counterbalance configured to be secured within the hollow recess, the adjustable counterbalance including:

an elongate member adapted to be secured to the tubular shaft; and a movable weight disposed about the elongate member and having a mass of from about 60 grams to about 80 grams, the movable weight including a first section, a second section, and a polymeric grommet disposed between the first section and the second section; wherein the movable weight is selectively transitionable from a first, unlocked state and a second locked state by rotating the first section relative to the second section to compress the grommet against the elongate member;

wherein the movable weight is translatable along the elongate member when in the unlocked state throughout a translatable range of from about 250 mm to about 400 mm, and wherein the movable weight is restrained from translation relative to the elongate member when in the locked state.

11. The golf putter of claim 10, wherein the elongate member is removable from the tubular shaft to facilitate repositioning of the movable weight along the elongate member and within the translatable range.

12. The golf putter of claim 10, wherein the movable weight is translatable along the elongate member by an applied force of less than about 1 lbf when in the unlocked state, and wherein the locked state is characterized by a holding force between the movable weight and the elongate member of from about 8 lbf to about 20 lbf.

13. The golf putter of claim 10, wherein the movable weight applies a compressive force to the grommet when in the locked state.

14. The golf putter of claim 10, wherein the grommet is formed from a thermoplastic polyurethane material; and wherein the grommet is annealed.

15. The golf putter of claim 10, wherein rotating the first section relative to the second section to transition the movable weight from the unlocked state to the locked state requires a torque of less than about 7.0 inch-pounds and may be performed by a user without the assistance of a tool; and wherein the movable weight is translatable along the elongate member by an applied force of less than about 1 lbf when in the unlocked state, and wherein the locked state is characterized by a holding force between the movable weight and the elongate member of from about 8 lbf to about 20 lbf.

16. The golf putter of claim 10, wherein the grip portion has a fixed mass; and wherein a ratio of the fixed mass to the mass of the movable weight is from about 0.75:1 to about 2.0:1.

* * * * *